United States Patent [19]

Kaufman et al.

[11] 3,955,394

[45] May 11, 1976

[54] STRIPPING DEVICE FOR IRONING PRESSES

[75] Inventors: Bruce F. Kaufman; Stanley J. Miller, both of Hastings, Mich.

[73] Assignee: Gulf & Western Manufacturing Company (Hastings), Southfield, Mich.

[22] Filed: Jan. 9, 1975

[21] Appl. No.: 539,733

[52] U.S. Cl. ..... 72/344

[51] Int. Cl.² ..... B21D 45/00; B21D 45/06

[58] Field of Search ..... 72/344, 345, 346, 349, 72/361, 427; 10/11 E, 76 T; 425/351, 422, 436 R, 438, 444, 436 RM

[56] References Cited

UNITED STATES PATENTS

| | | | |
|---|---|---|---|
| 2,369,260 | 2/1945 | Slater | 72/344 |
| 2,549,705 | 4/1951 | Offutt | 72/344 |
| 3,203,218 | 8/1965 | Bolt et al. | 72/344 X |
| 3,390,565 | 7/1968 | Smith et al. | 72/344 |
| 3,406,554 | 10/1968 | Frankenberg | 72/344 X |
| 3,664,171 | 5/1972 | Paramonoff | 72/344 |
| 3,735,628 | 5/1973 | Hutchison | 72/344 |

*Primary Examiner*—Milton S. Mehr
*Attorney, Agent, or Firm*—Meyer, Tilberry & Body

[57] ABSTRACT

A device is disclosed for stripping a cup-shaped metal can blank from the end of a reciprocable ram of a can ironing press. The device includes a plurality of stripper members circumferentially spaced apart about an axis aligned with the ram axis. Each of the stripper members is supported for pivotal movement about a corresponding axis transverse to the ram axis and is individually captured against axial, circumferential and radial displacement relative to the ram axis. Each stripper member includes a nose portion adapted to engage behind a can blank on the ram to strip the blank therefrom, and the nose is biased radially inwardly of the ram by a corresponding adjustable spring mechanism.

22 Claims, 7 Drawing Figures

STRIPPING DEVICE FOR IRONING PRESSES

The present invention relates to the art of can blank ironing presses and, more particularly, to a mechanism for stripping an ironed can blank from a reciprocable press ram.

Cup-shaped articles, such as seamless aluminum or steel can bodies having a closed end, are often produced by deep drawing a metal blank into a cup-shaped blank and then redrawing or ironing the cup-shaped blank to elongate and thin the side wall thereof to desired dimensions. Press mechanisms provided heretofore to achieve such an ironing operation generally include a reciprocable ram for supporting the can blank and one or more ironing rings through which the ram and blank are sequentially moved to achieve side wall ironing. Following completion of the ironing operation, the ram is retracted relative to the ironing ring or rings, and the ironed can blank is stripped from the end of the ram during the initial movement thereof in the retracting direction.

As is well known, such can blank stripping devices permit the ram and can blank thereon to move through the stripping device in the direction of ram advancement until the trailing edge of the can blank passed beyond the stripper members of the device. At this time, corresponding ends of the stripper members are displaced radially inwardly behind the trailing edge of the can blank to engage the ram whereby, upon retracting movement of the ram, the stripper members prevent movement of the can blank with the ram in the retracting direction. Accordingly, the can blank is stripped from the ram and is received or falls into a suitable mechanism by which the blank is discharged from the press. Constant and uniform alignment and clearance between the individual stripper members and the ram, and uniform biasing pressure of the stripper members toward the ram, are essential to achieving movement of the can blank and ram through the stripper mechanism during forward movement of the ram without scratching or otherwise marring the outer surface of the can blank. Moreover, such alignment and clearance is essential to achieving the best possible engaging relationship of the stripper members with the trailing end of the can blank during the retracting movement of the ram.

Heretofore, stripping devices have generally included a plurality of stripper members suitably supported in side-by-side relationship about an axis coinciding with the ram axis. Corresponding ends of the fingers are biased radially inwardly of the axis by a common garter-type spring, or the like, extending circumferentially about the stripper members. In such previous arrangements, the stripper members are generally structurally associated with the support member therefor in a manner which permits undesirable axial and circumferential displacement of the stripper members relative to one another and to the suppoprt member. The only restraint to such displacement is that provided by the garter-type spring or other biasing means. As a result of such relative movement or play between the stripper members and their support, desired alignment and constant and uniform clearance relationships between the stripper members and ram is at best extremely difficult to obtain and/or maintain. Moreover, the common biasing spring arrangement adds to the alignment and uniform clearance problems and, additionally, makes it most difficult, if at all possible, to obtain uniform biasing pressure against the individual stripper members.

In addition to the free play, alignment and biasing spring problems mentioned above, the side-by-side relationship and relative circumferential displacement permitted between the stripper members adds considerably to the time required to achieve maintenance and/or replacement operations with respect to the components of the assembly. In this respect, for example, if an individual stripper member is removed from the assembly for replacement or repair, the remaining stripper members tend to move circumferentially as a result of the space provided by such removal. Accordingly, the remaining stripper members must be circumferentially displaced and held to permit reinsertion of the repaired or new stripper member. Still further, stripper members in stripping devices of the foregoing character are often designed and produced in matched sets for a given press in order to achieve facial engagement between circumferentially adjacent stripper members completely about the periphery of the support therefor. Without such facial engagement the stripper members can be displaced or tilted circumferentially about the radially inner edges thereof and thus out of radial alignment with the ram axis. Accordingly, damage of one stripper member requiring replacement thereof can result in the necessity of replacing the entire set of stripper members in order to avoid a loss of circumferential continuity therebetween which would further adversely affect alignment and clearance capability.

In accordance with the present invention, a stripping device is provided which overcomes the problems encountered in connection with previous stripper devices, including those specific problems enumerated hereinabove. More particularly, the stripper device of the present invention is comprised of a plurality of stripper members individually captured against undesirable axial, circumferential and linear radial displacement with respect to the axis of an opening through the support therefor and, accordingly, with respect to the ram axis. Moreover, each stripper member is supported against circumferential tilting about an axis parallel to the ram axis. Further, each stripper member is pivotal about a corresponding axis transverse to the ram axis, and the can engaging nose of each stripper member is biased to pivot radially inwardly of the ram axis by a corresponding biasing arrangement. Preferably, the biasing arrangements are spring devices in which the biasing spring force is adjustable.

Axial, circumferential and radial capturing of each of the stripper members independent of the other enhances the ability to achieve substantially absolute and uniform alignment and clearance relationships between the stripper members and ram. In this respect, axial capturing minimizes axial end play between the stripper member and its support to the clearance necessary for pivotal movement of the stripper member. Radial capturing advantageously provides for eliminating linear radial play between the stripper member and its support and thus linear radial displacement of the stripper member relative to the ram. Thus, the radial position of the nose of the stripper member relative to the ram is accurately established and maintained. By capturing the stripper member circumferentially, and supporting the member against circumferential tilting, the stripper member is maintained in a desired attitude with respect to the ram and ram axis at all times. Accordingly, substantially absolute and uniform alignment and clearance between the stripper members and ram is obtained and maintained during use of the device. Moreover, the preferred adjustable biasing spring arrangement for each of the stripper members enables a uniform biasing force to be established and maintained for the several stripper members.

In accordance with the preferred embodiment of the invention, the stripper members are disposed in corresponding pockets defined by an assembly of plate members which are separably interconnected. Accordingly, the stripper members are readily accessible for replacement or repair by disassembly of the plate members. Moreover, the plate member assembly is removably mountable on an ironing press, and the spring mechanisms associated with the individual stripper members are accessible for adjustment without removing the plate assembly from the press. Accordingly, assembly, disassembly and maintenance time, and therefore down time of the press, is minimized.

An outstanding object of the present invention is the provision of an improved device for stripping a cup-shaped article from the end of a reciprocable ram.

Another object is the provision of a device of the foregoing character comprised of a plurality of stripper members individually supported relative to an axis coinciding with the ram axis to achieve more accurate alignment and clearance relationships with respect to the ram than heretofore possible.

Yet another object is the provision of a device of the foregoing character in which the stripper members are individually captured axially, circumferentially and radially with respect to the ram axis.

Still another object is the provision of a device of the foregoing character in which the individual captivity of the stripper members relative to the support therefore provides for pivotal movement of the nose of the stripper member radially of the axis of the device while minimizing axial end play, circumferential and radial displacement and circumferential tilting of the stripper member relative to the axis of the device.

A further object is the provision of a device of the foregoing character in which the noses of the stripper members are individually biased radially inwardly of the axis of the device in a manner whereby a uniform biasing force of the members against the ram is established and maintained.

Still a further object is the provision of a device of the foregoing character which is comprised of a minimum number of parts adapted to be readily assembled and disassembled to minimize installation, maintenance and replacement times and which while assembled provide for adjusting the biasing force against each of the stripper members.

Yet another object is the provision of a device of the foregoing character which is economical to produce, install and maintain and which is extremely efficient in operation.

The foregoing objects, and others, will in part be obvious and in part pointed out more fully hereinafter in conjunction with the written description of a preferred embodiment of the invention illustrated in the accompanying drawings in which.

Figure 1:
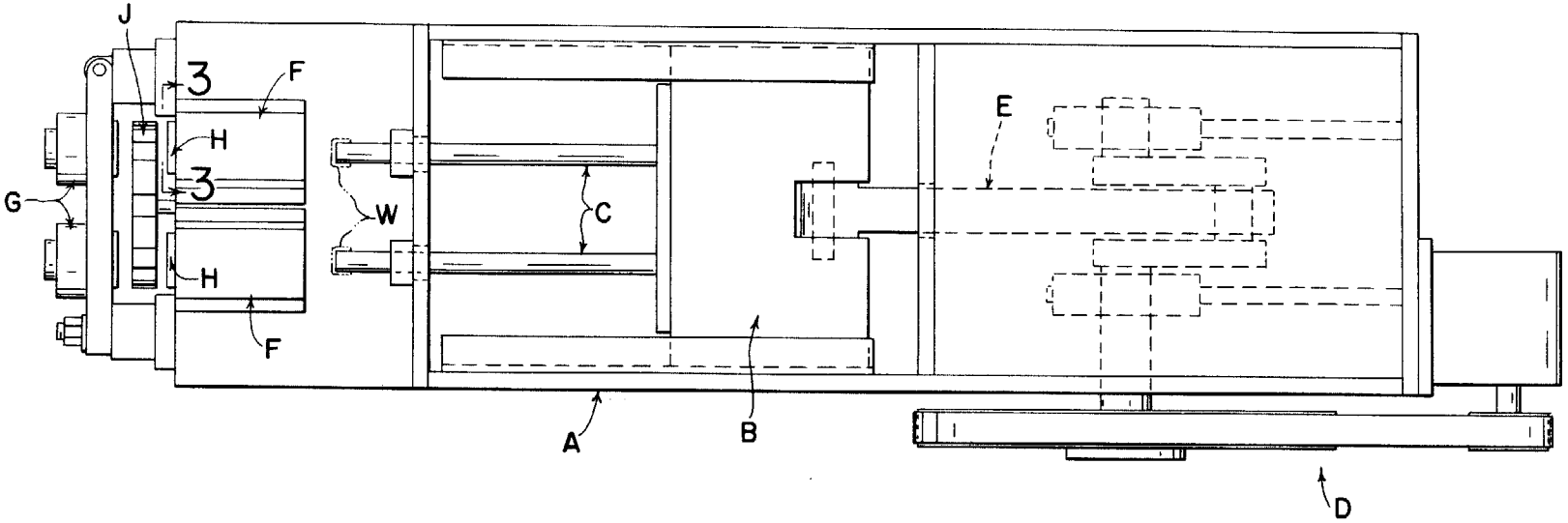
FIG. 1 is a plan view of a horizontal can ironing press and showing the stripping device of the present invention in its operative position thereon.
Figure 2:
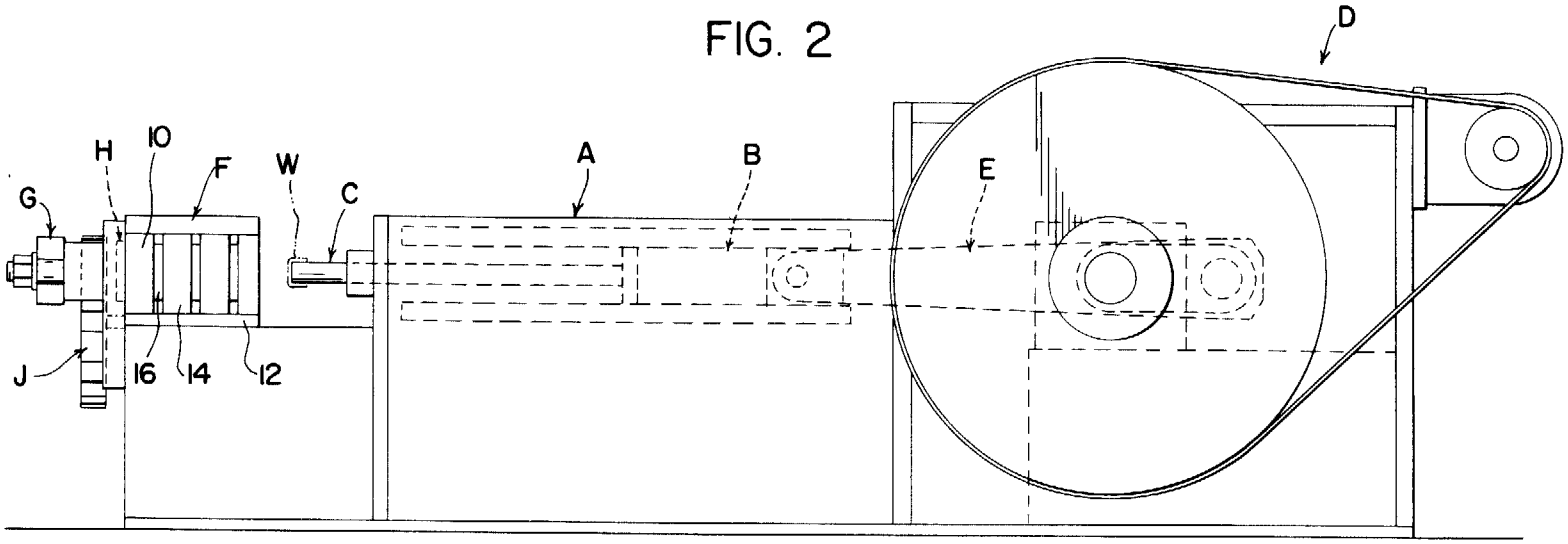
FIG. 2 is a side elevation view of the press illustrated in FIG. 1.

Referring now in greater detail to the drawings wherein the showings are for the purpose of illustrating a preferred embodiment of the invention only and not for the purpose of limiting the same, FIGS. 1 and 2 illustrate a horizontal can blank ironing press and show strippng devices of the present invention in operation relationship with respect to the components of such a press.

The press shown in FIGS. 1 and 2 includes a frame A supporting a horizontally reciprocable slide B. Slide B is provided with a pair of punches or rams C suitably mounted on the front end of the slide for movement therewith, and the rear end of the slide is interconnected with a suitable drive and transmission mechanism D through a connecting rod E. Drive and transmission mechanism D and connecting rod E are operable to impart reciprocating movement to slide B and thus to rams C. Such reciprocating movement displaces the rams between extending and retracted positions relative to corresponding tooling assemblies F mounted on frame A in cooperative axial alignment with the corresponding ram C. Doming devices G are axially aligned with rams C and are spaced axially from the tooling assemblies for engaging and doming a can blank end wall when the ram reaches its extended most position. Stripping devices H of the present invention are supported at the exit ends of tooling assemblies F to strip the formed can blank from the corresponding ram upon movement of the ram in the direction of retraction following the doming operation. While a dual press component arrangement is illustrated, it will be appreciated that such a dual arrangement is not necessary.

As is well known, the ram and tooling assembly components are cooperable to redraw or iron a cup-shaped can blank on the free end of the ram so as to elongate and thin the side wall of the can blank. More particularly, can blanks W to be ironed are placed on the free ends of the rams when the latter are in the retracted position as illustrated in FIGS. 1 and 2, and each tooling assembly F includes one or more ironing rings through which the corresponding can blanks and rams move in response to movement of the slide to the left in FIGS. 1 and 2. The ram and ironed can blank move freely through the corresponding stripping device in the direction of ram extension, and when the rams reach their extended positions, the free ends of the ram and the ironed can blanks thereon are positioned beyond the adjacent ends of the stripping devices. In the extended positions of the rams the end walls of the can blanks are domed axially inwardly by engagement of the can blank and ram with the corresponding doming assembly G. Following the doming operation, the ram moves in the retracting direction from left to right in FIGS. 1 and 2, and during initial retracting movement of the ram the can blank is stripped from the ram by the corresponding stripping device H. The stripped can blank is received in a suitable discharge mechanism J for transfer from the press.

Figure 3:
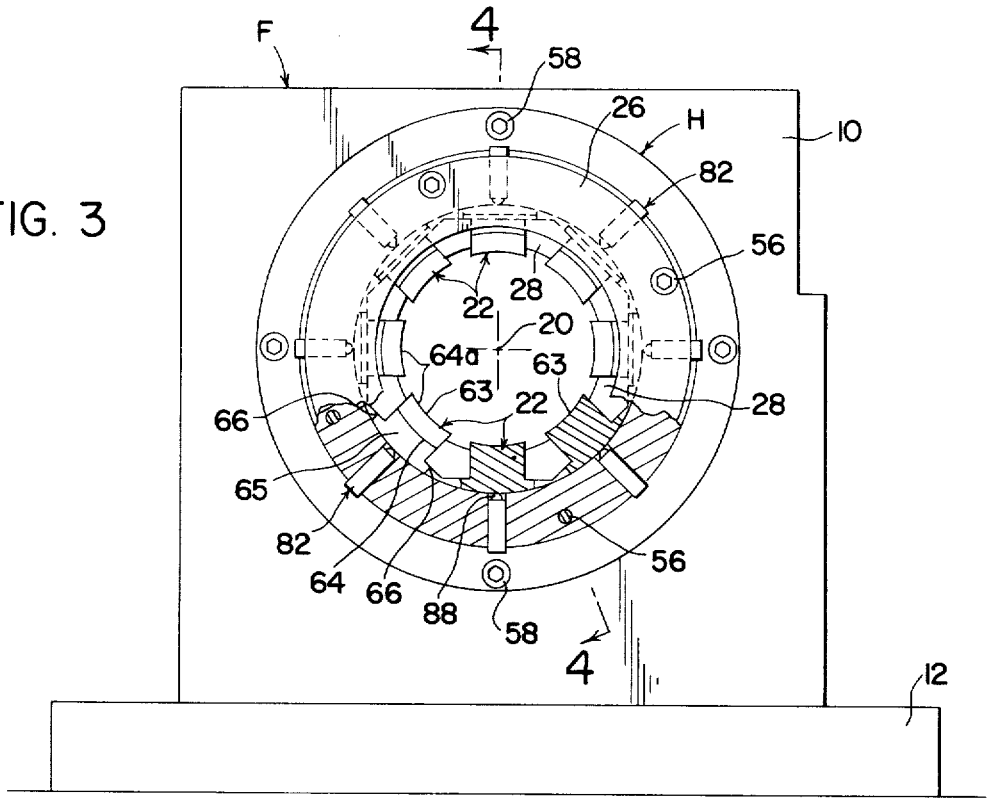
FIG. 3 is a front elevation view, partially in section of the stripping device of the present invention looking in the direction of line 3—3 in FIG. 1.
Figure 4:
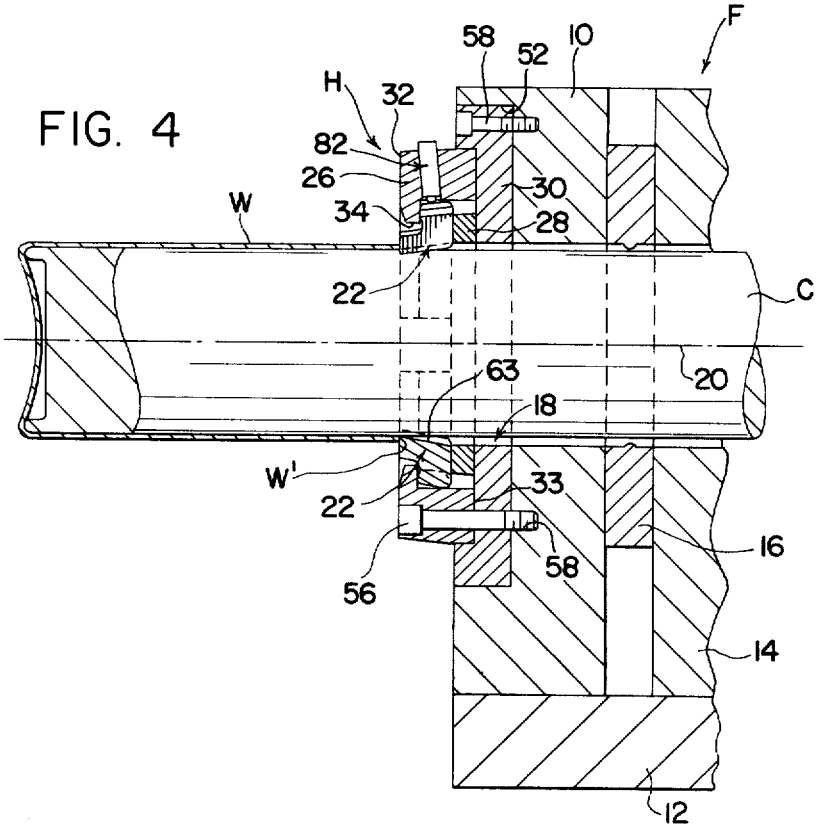
FIG. 4 is a sectional elevation view of the stripping device taken along line 4—4 in FIG. 3.
Figure 5:
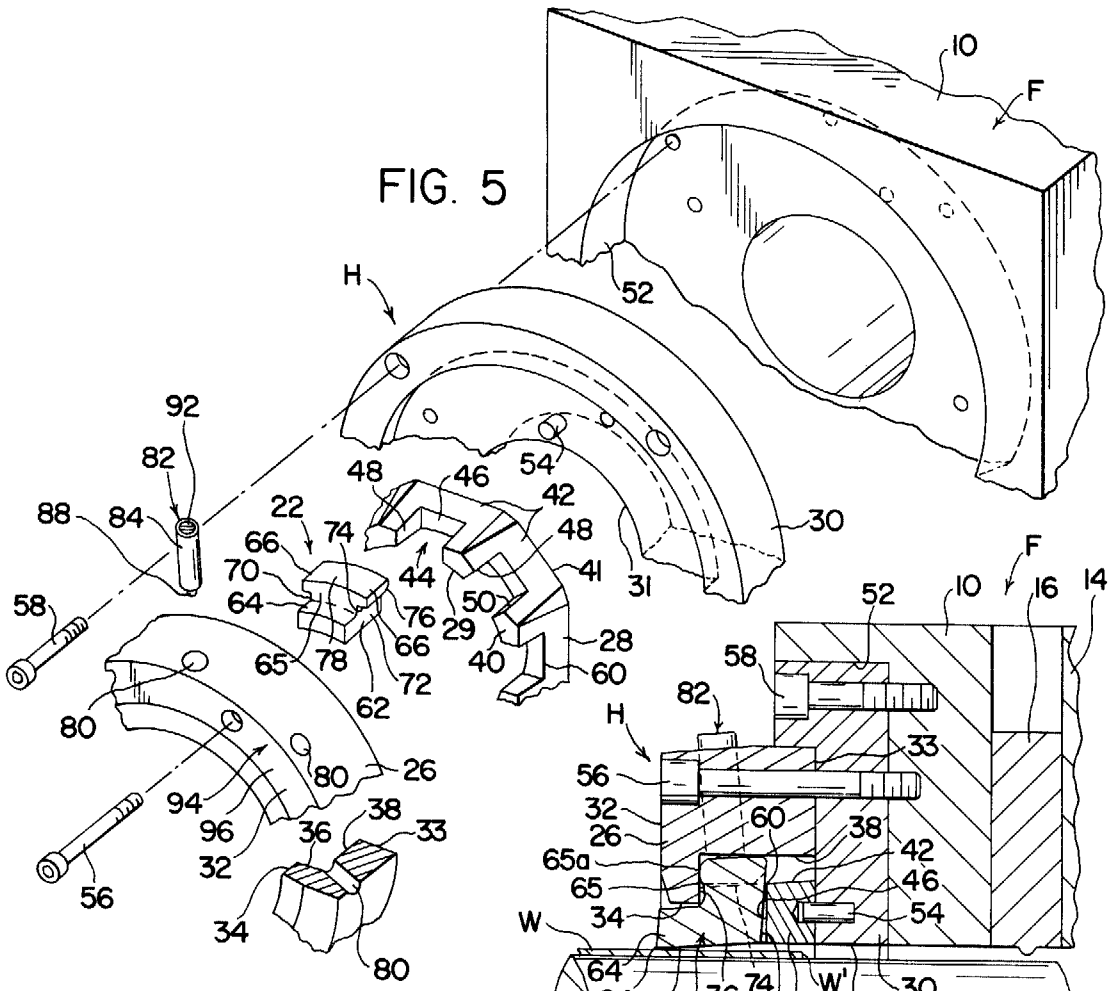
FIG. 5 is an exploded view of the components of the stripping device illustrated in FIGS. 3 and 4.

The structure of stripping devices H of the present invention is shown in FIGS. 3–7 of the drawing. Stripping devices H are identical and, accordingly, only one of the devices will be described in detail. As mentioned above, the stripping device is supported at the exit end of the corresponding tooling assembly F. Any suitable support arrangement can be employed and, in the embodiment illustrated, the stripping device is mounted on a support block component at the exit end of the tooling assembly. More particularly, as seen in FIGS. 3–5, the exit end of tooling assembly F is defined by a support block 10 bolted or otherwise fastened to a support plate 12 which in turn is suitably secured to frame A of the press. A support block 14 precedes block 10 with respect to the direction of movement of ram C through the tooling assembly, and an ironing ring 16 is suitably supported between blocks 10 and 14 for cooperation with ram C to iron the side wall of can blank W during movement of the ram therethrough in the direction from right to left in FIG. 4.

Stripping device H is mounted on support block 10, as described more fully hereinafter, and includes an opening 18 having an axis 20. Axis 20 is aligned in coaxial relationship with the axis of ram C when the stripping device is mounted on block 10. Opening 18 extends through the stripping device, and a plurality of stripper members 22 are spaced apart equidistant circumferentially about axis 20. Stripper members 22 are individually supported relative to axis 20 of opening 18 substantially against axial, circumferential and radial displacement relative to the latter axis. Moreover, the stripper members are supported for pivotal displacement about a corresponding axis transverse to axis 20, and are restrained from pivoting or tilting about an axis parallel to axis 20.

In the preferred embodiment, stripper members 22 are individually supported in the foregoing manner in pockets provided in a support plate arrangement mountable on support block 10 and including annular plates 26, 28 and 30. Plate 26 has an outer face 32 and an inner face 33 is provided with a radially stepped opening therethrough including a smaller diameter portion having a circular inner surface 34, a radial face 36 transverse to axis 20 and a larger diameter portion having a circular inner surface 38 extending from face 36 to inner face 33 of plate 26. Annular plate 28 is positioned within the larger diameter portion of the opening in plate member 26 adjacent radial face 36 and has an axial depth corresponding to surface 38. Plate 28 has a circular opening 29 therethrough and includes a front side 40 against radial face 36 and a rear side 41 coplanar with face 33 of plate 26.

Plate 28 further includes an outer surface defined by flat surfaces 42 and the plate has a major diameter generally corresponding to the diameter of inner surface 38 of the opening in plate 26. Each surface 42 is provided with a notch 44, which notches are circumferentially spaced apart and correspond in number to the number of stripper members 22. Notches 44 extend radially from faces 42 to inner surfaces 29 and extend axially from front side 40 toward rear side 41. Further, each notch 44 includes a planar rear wall 46 transverse to axis 20, and circumferentially spaced apart side walls 48 and 50 extending perpendicular to rear wall 46 and parallel to axis 20. Plate member 30 is in the form of an annular ring having a circular opening 31 therethrough. Ring 30 extends radially across faces 33 and 41 of plate members 26 and 28 and includes a peripheral flange about its outer edge axially receiving the inner end of plate member 26. Plate member 30 is received in a recess 52 provided therefor in mounting block 10.

Plates 26 and 28 are suitably interconnected against relative rotation therebetween and against relative rotation thereof relative to mounting block 10. In the embodiment disclosed, the latter relationship is achieved by interconnecting plates 28 and 30 such as by a cross key 54, and fastening plate members 26 and 30 to block 10 by corresponding threaded fasteners 56 and 58. It will be appreciated that many suitable arrangements can be employed for structurally interconnecting the several plate members with one another and with the support block or other support member on which the stripping device is mounted. Each of the notches 44 in plate 28 together with the corresponding portions of radial inner face 36 and inner surface 38 of member 26 and flat surface 42 adjacent the notch defines a pocket opening radially inwardly of opening 18 through the stripper device. Each pocket thus defined is adapted to receive and support one of the stripper members 22, as will be described hereinafter. Rear wall 46 of each notch intersects flat face 42 of plate 28 along an edge 60 which extends transversely of axis 20.

The structure of each stripper member 22 and the structural interrelationship of the stripper member with a corresponding pocket in the plate members is identical. Accordingly, only one such stripper member and pocket is described in detail, and it will be appreciated that the description is applicable to each stripper member and its corresponding pocket.

Figure 7:
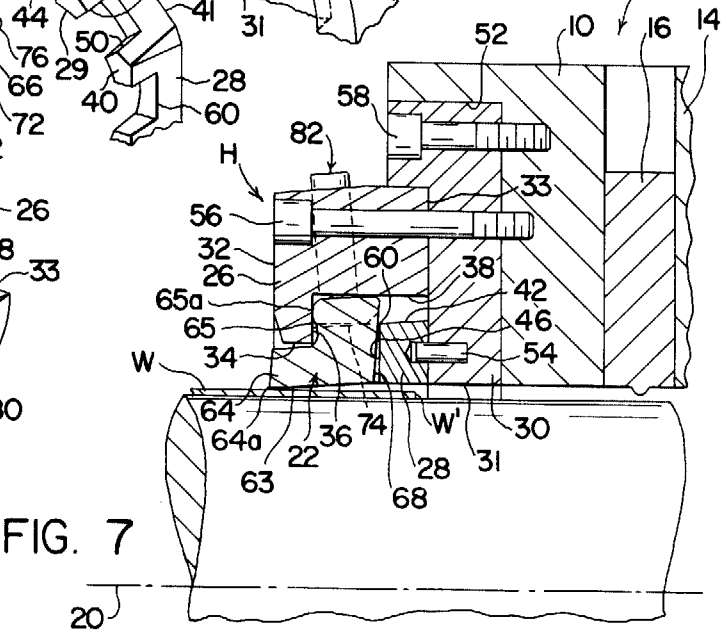
Figure 6:
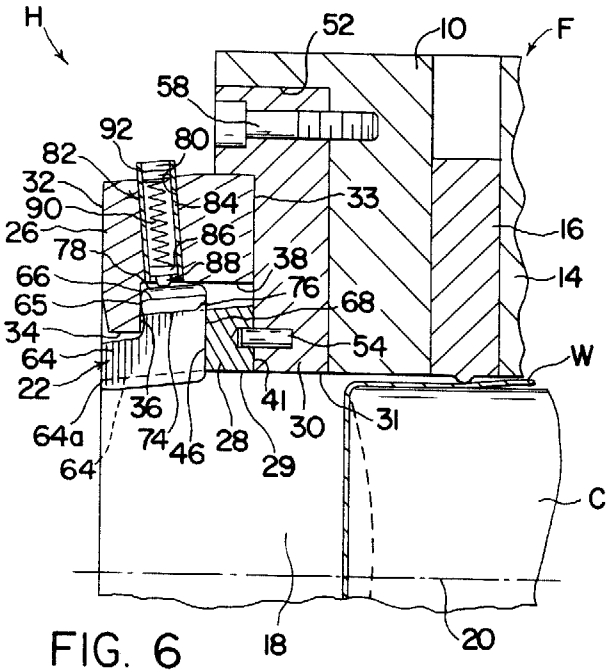
FIG. 6 is a detailed sectional elevation view illustrating the position of a stripper member prior to movement of the ram and can blank through the stripping device; and, FIG. 7 is a detailed sectional elevational view similar to FIG. 6 and illustrating the position of the stripper member during movement of the ram and can blank through the device.

As best seen in FIGS. 5, 6 and 7, each stripper member 22 includes a radially extending portion 62 disposed in notch 44, a nose portion 64 extending forwardly from portion 62 through the smaller diameter portion of the opening in plate 26, and circumferentially extending wings 66 overlying face 42 adjacent the sides of notch 44. Each stripper member includes a front face 65 adjacent radial face 36 of plate 26 and a rear face 68 against rear wall 46 of notch 44. Radial portion 62 of the stripper member has circumferentially spaced sides 70 and 72 respectively facially engaging sides 48 and 50 of notch 44. Wings 66 each include a bottom surface 74 overlying flat face 42 adjacent the notch and each surface 74 is chamfered adjacent rear face 68 of the stripper member to provide pivot edges 76 for the stripper member engaging face 42 forwardly of edge 60 of notch 44.

The radially outer surface 78 of stripper member 22 is circumferentially arcuate and conforms to the circular contour of surface 38. To enhance pivotal movement of member 22 without binding, the intersections between outer surface 78 and front and rear faces 65 and 68 are rounded as shown. Further, flat face 42 of plate member 28 inclines about 5° downwardly and forwardly from rear face 41 of the plate member, and wing surfaces 74 forwardly of edges 76 and outer surfaces 78 are also each inclined about 5° downwardly and forwardly with respect to rear face 68 of member 22. Further, the radial thickness of wing 66 between pivot edges 76 and outer surface 78 corresponds to the radial distance between flat face 42 and surface 38 of plate member 26. Accordingly, the stripper member i radially pivotal about edges 76 and is confined against linear radial displacement relative to axis 20 of the stripping device and against tilting or pivotal movement about an axis parallel to axis 20. Moreover, the stripper member is circumferentially captured by side walls 48 and 50 of notch 44 and is axially captured by rear wall 46 of the notch and rear face 36 of plate member 26, as set forth more fully hereinafter.

Stripper member 22 is normally in the position illustrated in FIG. 6 and is adapted to be pivoted to the position illustrated in FIG. 7 upon movement of the ram and the can blank thereon through the stripping device in the direction of advancement of the ram. The incline of flat face 42 and surfaces 74 and 78 of the stripper member enable the pivotal movement illustrated in FIGS. 6 and 7, and when the stripper member is in the normal position rear face 68 thereof facially engages rear wall 46 of notch 44 and surfaces 74 of the wings facially engage flat face 42 to limit counterclockwise pivotal movement of the stripper member as seen in FIG. 6. With further regard to retention of the stripper member against axial displacement thereof relative to axis 20 of the stripper device, radially extending portion 62 of the stripper member has an axial dimension and contour in the space between radial face 36 of plate member 26 and rear wall 46 of notch 44 which will permit the desired pivotal movement of the stripper member with minimum end play. This relationship is achieved in the embodiment disclosed by tapering front face 65 of the stripper member downwardly and inwardly at an angle of about 5° relative to rear face 68. This enables the pivotal movement and provides for the forwardmost edge 65a of surface 65 to have minimum axial clearance with respect to radial face 36. Accordingly, the axial distance between the plane of rear face 68 and a plane parallel thereto and tangent to edge **65*a* corresponds generally to the axial distance between radial face 36 and notch wall 46. The stripper member is therefore axially captured to minimize axial displacement thereof relative to axis 20, and the tapered front face 65 provides for the stripper member to pivot counterclockwise as illustrated in FIGS. 6 and 7 without interference with radial face 36.**

As is best seen in FIG. 7, stripper member 22 has an axially extending inner surface 63 which is curved circumferentially to conform with the circular contour of the outer surface of ram C. When the stripper member is in its normal position surface 63 inclines axially inwardly and upwardly from the axially outer face of nose 64 to inner face 68 of the stripper member. Further, surface 63 intersects with the axially outer face of nose 64 along a circumferential line 64a spaced radially inwardly with respect to openings 29 and 31 in members 28 and 30. Edge **64*a* has a circumferential contour corresponding to that of ram C, and when the stripper member is in its normal position edge 64*a* is radially spaced from axis 20 a distance slightly less than the radius of ram C. Moreover, it will be appreciated that openings 29 and 31 through plate members 28 and 30** are of a diameter larger than the diameter of ram C and an ironed can blank on the end thereof.

Nose 64 of each stripper member 22 is spring biased toward the normal position thereof illustrated in FIG. 6 by a corresponding spring mechanism acting radially against outer surface 78 of the stripper member at a location forwardly of pivot edges 76. In this respect, plate member 26 is provided with a plurality of radially extending bores 80, each of which opens to inner surface 38 in a position overlying surface 78 of the corresponding stripper member. Any suitable biasing spring arrangement can be employed and in the embodiment illustrated each bore 80 receives and supports a spring plunger assembly 82 including a tubular casing 84 supporting a reciprocable plunger 86 having an end 88 projecting through the casing to engage the underlying stripper member. A compression spring 90 is disposed in the casing behind plunger 86 and, preferably, the force of spring 90 against the plunger is adjustable such as by means of an end cap 92 threadedly interengaged with casing 84. The outer ends of the spring assemblies are radially exposed to facilitate rotation of cap 92 to adjust the spring force.

With further regard to biasing spring assemblies 82, each of the assemblies is disposed with its axis coplanar with a corresponding radial plane through axis 20 of the stripper device. Moreover, the axis of the spring device preferably is inclined at an angle of about 5° in the latter plane for the outer end of the spring device to be closer to face 32 of plate 26 than is the inner end. This orientation of the spring devices facilitates access thereto for adjustment while the stripper device is mounted on the press and, more importantly, applies the spring force to the corresponding stripper member perpendicular to flat faces 42 on which wing surfaces 74 normally seat.

From the foregoing description it will be seen that during advancement of the ram toward the extended position, the ram and an ironed can blank W thereon are adapted to freely pass through opening 18 of the stripper device which is defined by the openings through plate members 26, 28 and 30. Further, during movement of the ram and can blank through opening 18 the forward edge of the can blank engages inner surfaces 63 of the stripper members at a location forwardly of the pivot edges 76, whereby the noses of the stripper members are pivoted radially outwardly of axis 20 to permit movement of the ram and can blank therepast. When the trailing edge W′ of the can blank passes edges **64*a* of the stripper members, the noses of the stripper members are biased to pivot radially inwardly of axis 20 by the corresponding spring mechanism 82, whereby edges 64a slideably engage the outer surface of the ram. When the ram then moves in the direction of retraction from left to right in FIG. 4, trailing edge W′ of the can blank engages the axially outer faces of noses 64, whereby movement of the can blank with the ram is interrupted. Accordingly, continued movement of the ram in the direction of retraction causes the ram to be withdrawn from within the can blank, and when the end of the ram passes trailing edge W′ of the can blank the latter is free to descend relative to the stripper device and into a discharge mechanism for the press. As the ram moves in the retracting direction out of engagement with edges 64*a* and inner surfaces 63 of the stripper members, the latter are biased by the corresponding spring mechanisms 82** to the normal positions thereof.

While considerable emphasis has been placed herein on a specific structure and structural interrelationship between the components of the stripper device, it will be appreciated that many modifications of the disclosed arrangement will be suggested upon reading and understanding the description of the preferred embodiment and that such changes can be made without departing from the principles of the present invention. Many structural designs of the stripper members and the support therefor, as well as modifications of the structures illustrated and described herein, can be devised to achieve the desired stripper member support and will be apparent to those skilled in the art. Moreover, while eight stripper members are illustrated in the preferred embodiment, it will be appreciated that the number of stripper members can be varied. Still further, while the stripping device of the preferred embodiment is illustrated as being mounted on a support block of the ironing ring tool assembly, it will be appreciated that the stripper device can be otherwise supported on the press frame adjacent the exit end of the tooling assembly in operative alignment with the press ram.

As many possible embodiments of the present invention may be made and as many possible changes may be made in the embodiment herein disclosed, it is to be distinctly understood that the foregoing descriptive matter is to be interpreted merely as illustrative of the invention and not as a limitation.

What is claimed is:

1. A device for stripping a cup-shaped article from the end of a reciprocable ram comprising: stripper member support means having an opening therethrough to freely receive said ram and article, a plurality of stripper members circumferentially spaced apart with respect to the axis of said opening and each having an article engaging end pivotal radially of said opening axis, said stripper member support means including means defining a plurality of separate pockets each receiving a corresponding one of said stripper members in detached relationship with respect thereto, each said pocket alone confining said corresponding one of said stripper members axially, circumferentially and radially with respect to the axis of said opening and for pivotal displacement of said article engaging end of the corresponding stripper member radially inwardly and outwardly relative to said axis, and separate biasing means for each stripper member, said biasing means acting against the corresponding stripper member to bias the article engaging end thereof radially inwardly of said axis of said opening.

2. The device according to claim 1, wherein each said separate biasing means is adjustable spring means.

3. The device according to claim 1, wherein each of said pockets has axially spaced pocket ends, circumferentially spaced pocket sides and radially spaced inner and outer pocket surface means, and each of said stripper members has axially spaced stripper member surfaces facing a corresponding one of said axially spaced pocket ends, circumferentially spaced stripper member sides facing said pocket sides and radially spaced inner and outer stripper member surfaces facing said inner and outer pocket surface means.

4. The device according to claim 3, wherein said separate biasing means include spring biased reciprocable plunger means having an axis extending radially of the corresponding stripper member.

5. The device according to claim 4, wherein the biasing force of said spring biased plunger means against the corresponding stripper member is adjustable.

6. The device according to claim 3, wherein said sides of said pocket and one of said pocket ends are defined by a radial passage in said stripper member support means having an inner end communicating with said opening therethrough and having an outer end intersecting said inner surface means of said pocket, said stripper member having a radially extending portion in said passage and wings extending circumferentially from said radial portion and overlying said inner surface means of said pocket, said wings having inner faces defining said surfaces of said stripper member facing said inner surface means of said pocket, and said inner faces including pivot edge means for said stripper member extending transverse to said axis of said opening.

7. The device according to claim 6, wherein said article engaging end of said stripper member is spaced from said one pocket end in the direction toward the other of said pocket ends, said pivot edge means being located between said one pocket end and said article engaging end, and said axially spaced surfaces of said stripper member facing said pocket ends including an end face on said radially extending portion of said stripper member engaging said one end of said pocket to limit pivotal movement of said article engaging end of said stripper member radially inwardly of said opening axis.

8. The device according to claim 7, wherein said separate biasing means for each stripper member includes compression spring means, said spring means acting radially against said stripper member at a location between said pivot edge means and said article engaging end.

9. The device according to claim 8, wherein the biasing force of said compression spring means against said corresponding stripper member is adjustable.

10. A device for stripping a cup-shaped article from the end of a reciprocable ram comprising: plate means having opposite sides and an opening therethrough to receive said ram and article, said plate means including means defining a plurality of circumferentially spaced apart pockets between said opposite sides and having inner ends communicating with said opening and outer ends spaced radially from said opening, each of said pockets including axially spaced apart radial end faces, circumferentially spaced apart side faces, and radially spaced apart inner and outer surfaces at said outer end, a radially pivotal stripper member in each of said pockets and detached with respect thereto, said stripper member being radially, axially and circumferentially confined in said pocket and including a first portion in said outer end of said pocket and a second portion extending radially from said first portion and through said inner end of said pocket, said first portion of said stripper member including means disposed between said inner and outer surfaces at said outer end of said pocket to radially confine said stripper member, said second portion of said stripper member including side walls facially engaging said side faces of said pocket to circumferentially confine said stripper member, and said first and second portions of said stripper member including axially spaced wall means facing said end faces of said pocket to axially confine said stripper member, said means on said first portion of said strip per member including means defining a stripper mem ber pivot edge at said inner surface in the outer end o said pocket, said second stripper member portion hav ing a stripper nose in said opening through said plat means, and individual spring means for each said strip per members, each said spring being supported by sai plate means and acting against the corresponding strip per member to bias said stripper nose to pivot radiall inwardly of said opening about said pivot edge.

11. The device according to claim 10, wherein eac said individual spring means is adjustable to adjust th bias against the corresponding stripper member.

12. The device according to claim 11, wherein each said individual spring means includes spring biased reciprocable plunger means having an axis and supported by said plate means to radially engage said first portion of said corresponding stripper member at a location axially between said pivot edge and said stripper nose.

13. The device according to claim 10, wherein said axially spaced wall means of said stripper member includes an end wall on said second portion of said stripper member and said end faces of said pocket include a corresponding wall between said inner and outer ends of the pocket, said end wall engaging said corresponding wall to limit pivotal movement of the stripper nose radially inwardly of said opening.

14. The device according to claim 10, wherein said plate means includes a first plate having a radially stepped circular opening therethrough and a second plate having an opening therethrough, said second plate being disposed in the larger diameter portion of said stepped opening and against the radial wall between the smaller and larger diameter portions of said stepped opening, said second plate including radially extending notches opening between said opening through said second plate and the larger diameter portion of said stepped opening, each of said notches having a rear wall spaced from and facing said radial wall of said first plate member and side walls extending from said notch wall toward said radial wall, said notch rear wall and radial wall defining said axially spaced end faces of said pocket, and said notch side walls defining said side faces of said pocket.

15. The device according to claim 14, wherein said second plate includes flat surfaces extending circumferentially from said notch side walls at the radially outer ends thereof, said flat surfaces being radially spaced from said larger diameter portion of said stepped opening, and said flat surfaces and larger diameter portion of said stepped opening defining said inner and outer surfaces of said pocket.

16. The device according to claim 15, wherein said first plate includes radial apertures for said spring means, said radial apertures extending through said first plate from the outer surface thereof to the inner surface of said larger diameter portion of said stepped opening, each said spring means including plunger means supported in a corresponding one of said radial apertures and having an inner end radially engaging said stripper member and a compression spring biasing said plunger means radially inwardly of said aperture.

17. The device according to claim 16, wherein said spring means further includes means for adjusting the compression force of said spring against said plunger means.

18. The device according to claim 15, wherein said first stripper member portion means are wings having bottom surfaces overlying said flat surfaces on said second plate member, said first stripper member portion having a top surface spaced radially outwardly from said bottom surfaces, said wings having an end adjacent said notch rear wall, and said bottom surface of each wing including angularly related surface portions intersecting along an edge line spaced from and parallel to the radial outer edge of said notch rear wall, said edge lines of said wings together defining said stripper member pivot edge.

19. The device according to claim 18, wherein said axially spaced wall means of said first and second portions of said stripper member includes a rear wall engaging said notch rear wall to limit pivotal movement of said stripper nose radially inwardly of said opening through said device, and a front wall facing said radial wall of said first plate.

20. The device according to claim 19, wherein said flat surfaces of said second plate incline downwardly in the direction from said notch rear wall toward said radial wall of said first plate, and said wings have a radial dimension between said edge line and said top surface of said first stripper member portion corresponding to the radial space between said flat surfaces and said larger diameter portion of said stepped opening through said edge line.

21. The device according to claim 20, wherein said first plate includes radial apertures for said spring means, said radial apertures extending through said first plate from the outer surface thereof to the inner surface of said larger diameter portion of said stepped opening, each said spring means including plunger means supported in a corresponding one of said radial apertures and having an inner end radially engaging said stripper member and a compression spring biasing said plunger means radially inwardly of said aperture.

22. The device according to claim 21, wherein said spring means further includes means for adjusting the compression force of said spring against said plunger means.

* * * * *